United States Patent [19]

Pickert et al.

[11] 4,030,430

[45] June 21, 1977

[54] APPARATUS FOR SEWING SLIDE FASTENERS TO ELASTIC CARRIERS

[75] Inventors: Hansjürgen Pickert, Kerkrade, Netherlands; Hans Dieter Sesselmann, Rodingen, Germany; Leonardes August Timmers, Mechelen, Netherlands

[73] Assignee: William Prym-Werke KG, Stolberg, Rhineland, Germany

[22] Filed: Feb. 18, 1975

[21] Appl. No.: 550,489

[30] Foreign Application Priority Data

Feb. 16, 1974 Germany ..... 2407558

[52] U.S. Cl. ..... 112/121.26; 112/121.15

[51] Int. Cl.[2] ..... D05B 21/00

[58] Field of Search ..... 112/121.26, 104, 113, 112/114, 265, 2, 155, 136, 121.15

[56] References Cited

UNITED STATES PATENTS

| | | | |
|---|---|---|---|
| 2,444,335 | 6/1948 | Coppock | 112/121.15 |
| 3,542,262 | 11/1970 | Ewert | 112/121.26 X |
| 3,713,408 | 1/1973 | Deeks et al. | 112/121.26 X |
| 3,750,604 | 8/1973 | Carrel et al. | 112/265 |
| 3,903,818 | 9/1975 | Marforio | 112/121.26 X |

FOREIGN PATENTS OR APPLICATIONS

| | | | |
|---|---|---|---|
| 1,293,461 | 10/1972 | United Kingdom | 112/136 |

*Primary Examiner*—Werner H. Schroeder
*Assistant Examiner*—Peter Nerbun
*Attorney, Agent, or Firm*—Michael J. Striker

[57] ABSTRACT

Apparatus for simultaneously sewing two coupled stringers of a slide fastener onto portions of a carrier to opposite sides of an elongated slit therein, in which the carrier is elastic in the direction of the slit, in which a slide carrying a device for releasably holding one end of the slide fastener and one end of the carrier in the region of the slit therein is movable along an elongated guide rail fastened at one end to a two-needle sewing machine in the region of the needle plate of the latter, and in which the slide is biased with a substantially contact force in a direction toward the other end of the guide rail, that is in a direction opposite to that in which the slide fastener and the carrier move during the sewing operation to thereby keep the elastic carrier during the sewing operation under constant tension.

8 Claims, 3 Drawing Figures

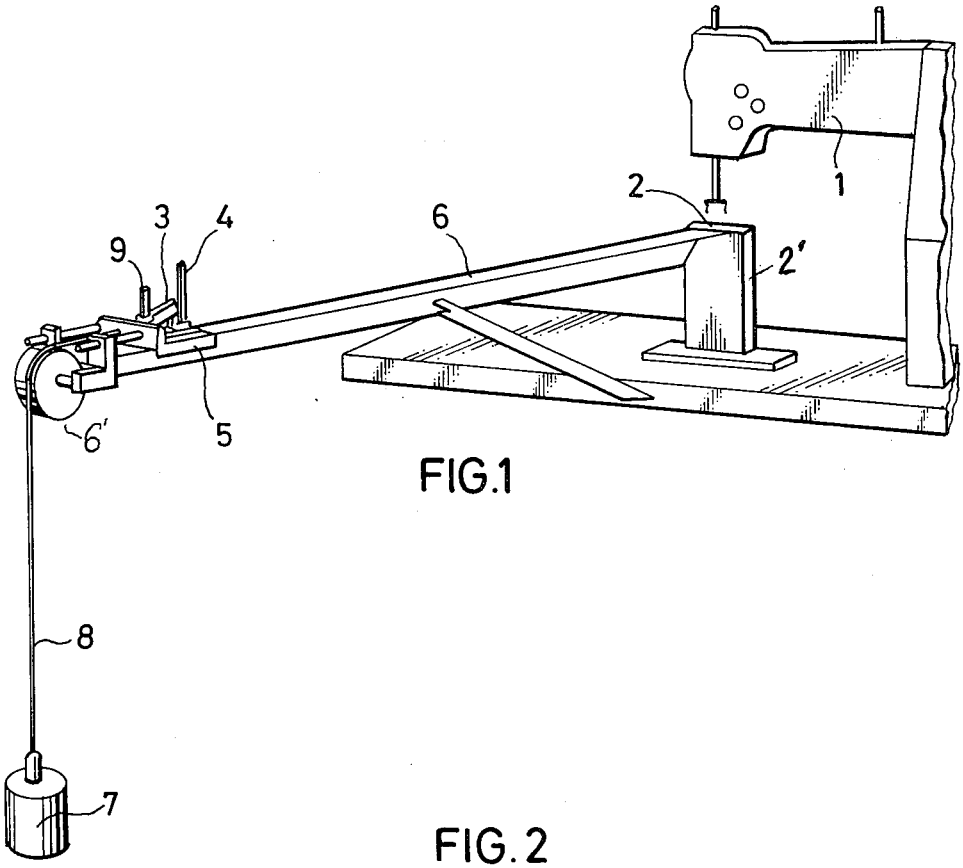
FIG.1
FIG.2
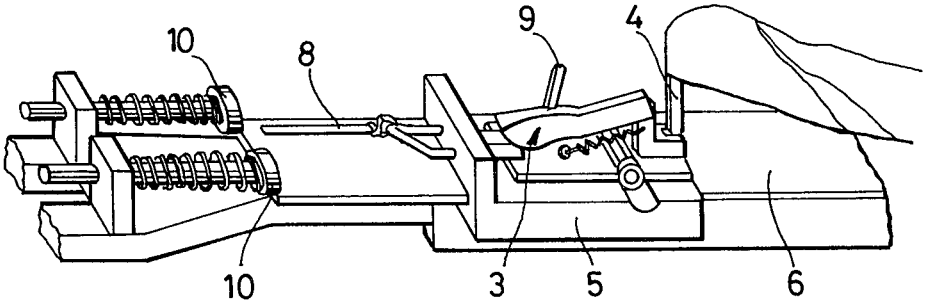

APPARATUS FOR SEWING SLIDE FASTENERS TO ELASTIC CARRIERS

BACKGROUND OF THE INVENTION

The present invention relates to an apparatus for simultaneously sewing two coupled stringers of a slide fastener onto portions of a carrier to opposite sides of an elongated slit therein, and in which the carrier is elastic in the direction of the slit. In sewing operations it is often necessary to sew two coupled stringers of a slide fastener onto portions of a highly elastic material to opposite sides of an elongated slit therein in which the length of the slide fastener has to be determined in such a manner that this length corresponds with the length of the slit in tensioned condition of the carrier material. This problem arises for instance in series manufacturing of slip covers for upholstered furniture or the like. Thereby it is common practice to use for the slip covers elastically expandable material and to manufacture the slip covers to smaller dimensions than the upholstered parts they have to cover, so that after inserting the upholstered part in the manufactured slip cover, the latter will adhere perfectly flat and without folds to the upholstered part.

The carrying out of such a sewing operation required considerable experience and skill of the sewing machine operator, since it was necessary that the elastic material of the slip cover was held during the sewing operation by the operator under uniform pretension corresponding to the finished dimensions of the upholstered parts. Nonuniformity of the pretension controlled by the hand of the operator was leading on the finished product to undesirable fold formation.

Auxiliary devices for sewing machines are already known by means of which an elastically stretchable textile material may be sewn to substantially nonstretchable textile material in such a manner to make a uniform arrangement of the stretchable material on the unstretchable material possible. Such an auxiliary device is for instance shown in the U.S. Pat. No. 3,542,262. With such a device it is however not possible to produce seams simultaneously to opposite sides of an elongated slit in the stretchable material. Furthermore, the known auxiliary device requires a cumbersome adjustment of the clamping means thereon so that this device is unsuitable for efficient manufacturing such articles in large series.

SUMMARY OF THE INVENTION

It is an object of the present invention to provide for an apparatus for simultaneously sewing two coupled stringers of a slide fastener onto portions of a carrier to opposite sides of an elongated slit therein in which the carrier is elastic in the direction of the slit.

It is a further object of the present invention to provide for such an apparatus which can be used in a very efficient manner in sewing operations, and which does not require cumbersome adjustment of the apparatus during or after the sewing operation.

It is an additional object of the present invention to provide an apparatus of the aforementioned kind which is composed of relatively few and simple parts so that the apparatus may be manufactured at reasonable cost and will stand up properly under extended use.

With these and other objects in view, which will become apparent as the description proceeds, the apparatus according to the present invention for simultaneously sewing two coupled stringers of a slide fastener onto portions of a carrier to opposite sides of an elongated slit therein, in which the carrier is elastic in direction of the slit, mainly comprises a two-needle sewing machine having a needle plate, a slide, means on the slide for releasably holding the coupled stringers of a slide fastener in the region of one end of the latter and the carrier in the region of one end of the slit therein, elongated guide means having one end fastened to the sewing machine in the region of the needle plate thereof and at an opposite end for guiding the slide toward and away from the needle plate, and means connected to the slide for biasing the same with a substantially constant force toward the opposite end of the guide means in a direction opposite to the advance of the slide fastener and carrier during the sewing operation.

The aforementioned biasing means preferably comprise an elongated flexible member connected at one end thereof to the slide and a weight connected to the other end of the elongated flexible member which is preferably guided over a roller on the opposite end of the elongated guide member. By changing the weight it is possible in a very simple manner to adapt the apparatus according to the present invention to different characteristics of the material of the carrier. The aforementioned holding means include clamping means for clamping the aforementioned end of the slide fastener to the slide and such a clamping means are provided with an actuating lever so that the operator when he nears the end of the sewing operation may in very simple manner release the connection between the slide and the slide fastener end, in order to finish the sewing operation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a schematic perspective view of the apparatus according to the present invention;

FIG. 2 is a partial perspective view of the apparatus shown in FIG. 1 and drawn to an enlarged scale.

DESCRIPTION OF THE PREFERRED EMBODIMENT

Figure 3:
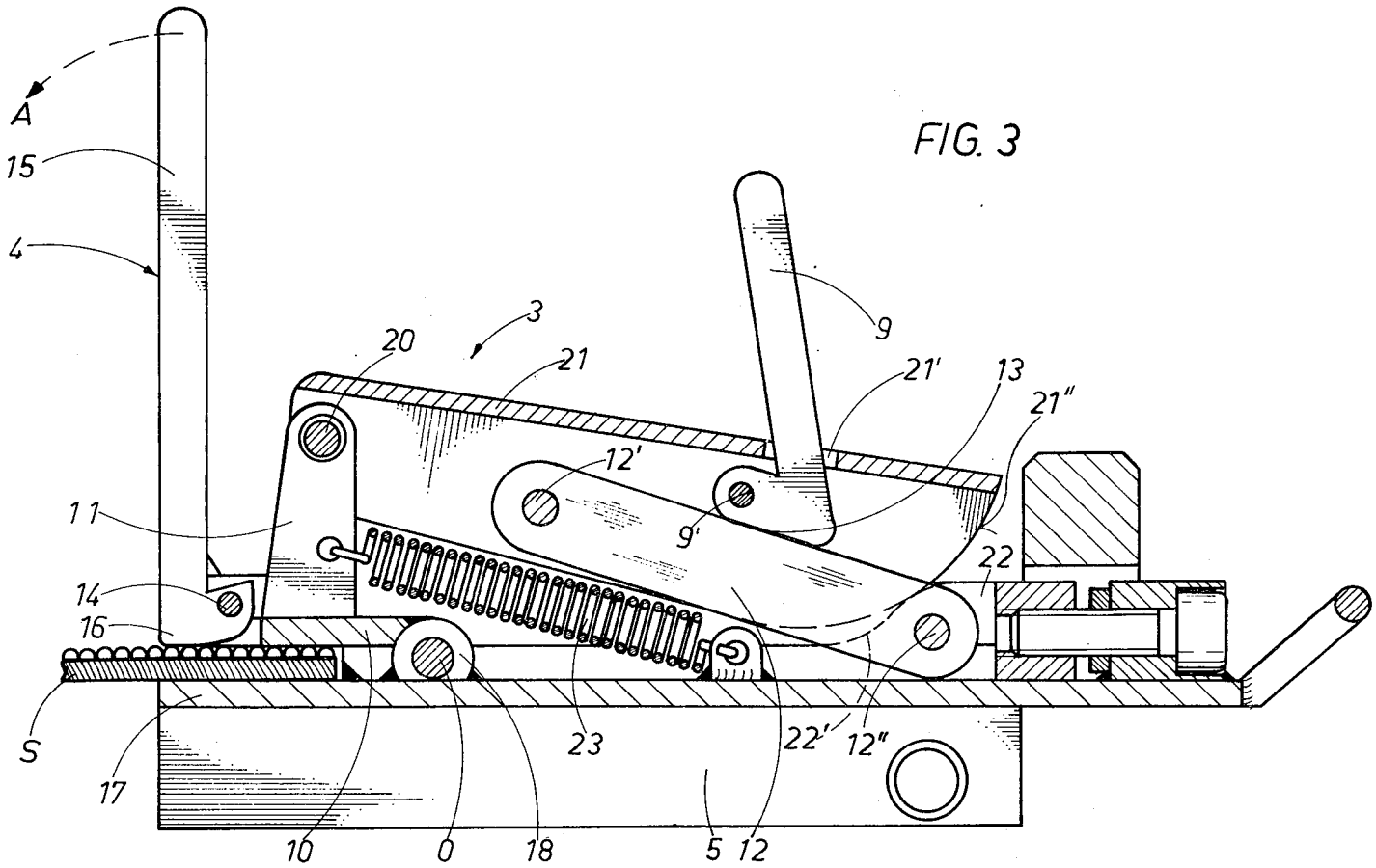
FIG. 3 is a partially sectioned side view of the part of the apparatus shown in FIG. 2, drawn to an enlarged scale and through 180° reversed with respect to FIG. 2.

Referring now to the drawing, and more specifically to FIG. 1 of the same, it will be seen that the apparatus according to the present invention comprises a two-needle sewing machine 1 having a needle plate 2 mounted on the upper end of a column 2' of the sewing machine. An elongated guide means, shown as an elongated guide rail 6, is connected at one end to the column 2' in the region of the needle plate 2 thereon and intermediate its ends to the table of the sewing machine. The elongated guide rail 6 extends substantially in a direction coinciding with the advancing direction produced by the sewing machine in known manner on the material during the sewing operation. A slide 5 is mounted on the guide rail 6 movable in longitudinal direction thereof. An elongated flexible member, for instance a rope 8, is connected at one end to the slide 5, whereas the other end of the rope 8 carries a weight 7. The rope 8 is guided intermediate its ends over a roller 6' connected to the free end of the guide rail 6. The rope 8 and the weight 7 thereon therefore constitute biasing means for biasing the slide 5 toward the free or left end, as viewed in FIG. 1, of the guide rail 6. The guide rail 6 carries also at its left end, as viewed in FIG. 1, a springy shock absorber 10 of a construction more clearly illustrated in FIG. 2. The slide 5 carries clamping means 3 for clamping the ends of the two stringers of a slide fastener S distant from the sewing machine 1.

The construction of the clamping means 3 are best shown in FIG. 3. As shown therein the clamping means comprise a clamping plate 10 connected by a hinge 18 to the slide 5 so as to be pivotable about the axis 0 of the hinge. The plate 10 carries distant from the hinge 18 an upright support member 11 to the upper end of which an elongated connecting member 21 of U-shaped cross section is hinged at 20. Located within the member 21 of U-shaped cross section is a link 12 pivotally connected at 12' to the member 21 and at 12'' to a member 22 projecting in substantially horizontal direction from the right end of the slide 5, as viewed in FIG. 3, toward the left and which is arranged rearwardly of the link 12. The member 21 carries also in its interior a lever 9 pivotally connected thereto at 9' and projecting through an opening 21' in the member 21 outwardly of the latter. The lever 9 has a lower curved end 13 engaging the upper face of the link 12. A coil tension spring 23 is connected at opposite ends to the member 11 and to the slide 5, which spring extends in the clamping position shown in FIG. 3 substantially parallel to the link 12. A plate 17 is located opposite the plate 10 so that in the clamping position, as shown in FIG. 3, the ends of the stringer of the slide fastener S may be clamped between the bottom face of the plate 10 and the top face of the plate 17. The side walls of the connecting member 21 of U-shaped cross section have curved rear end faces 21'' abutting in the clamping position shown in FIG. 3 against a curved cam face 22' of the member 22.

The slide 5 carries also a holding member 4 having a long upwardly projecting arm 15 and a short lower arm 16 extending transverse to the long arm 15 and being pivoted at 14 to the plate 10. In the clamped position, as shown in FIG. 3 the lower arm 16 will engage with the left-end of its bottom face, as viewed in FIG. 3, on the row of elements of the clamped slide fastener S so as to hold the long arm 15 in substantially upright position as shown, and the arm 15 will extend with its bottom end also on the row of elements of the clamped slide fastener.

The sewing of slide fasteners into tubular slip covers is carried out with the apparatus of the present invention in the following manner:

The tubular slip cover is prepared before the sewing operation in such a manner that not only the side to which the slide fastener has to be sewn but also the opposite side of the slip cover is to be open, whereby however the side to be provided with the slide fastener is sewn at both of its ends for a short distance in order to determine the width of the seam. The thus prepared slip cover is now placed onto the sewing machine in such a manner that the slip cover is pulled from one end of the slit therein toward the other end beneath the presser foot (not shown) of the sewing machine. Thereby the column 2' of the sewing machine will be placed into the interior of the tubular slip cover. Subsequently thereto the two coupled stringers of a slide fastener of predetermined length are placed onto the needle plate 2 of the sewing machine and the upper surface of the guide rail 6 and clamped at one end by the presser foot of the sewing machine. Subsequently thereto portions of the slip cover in the region of the rear end of the slit therein are placed between the presser foot and the needle plate 2 without displacing the slide fastener. After this operating step, the slide fastener and the material of the slip cover adjacent one end of the slit therein are held in place by the presser foot. Subsequently thereto the operator will move the slide 5 toward the sewing machine and the opposite free end of the slide fastener is clamped between the plates 10 and 17 of the clamping means 3 on the slide by turning the lever 9 to the position shown in FIG. 3. The long arm 15 of the holding member is inserted at the same time into the opposite end of the slit of the slip cover. The slide 5 is then released so that it moves under the influence of the weight 7 connected thereto by the rope 8 toward the left end, as viewed in FIG. 1, of the guide rail 6 so that the slip cover which is elastic in the direction of its slit is stretched to the length of slide fastener. Subsequently thereto the sewing machine is started and the slide fastener is sewn to the slip cover. During the sewing operation which starts with an interlocking stitch at the start of the seam, the portions of the slip cover to opposite sides of the slit are folded by the operator so that the folded edges of the slip cover will abut along a longitudinal center line of slide fastener and cover the same when the slip cover is sewn to the slide fastener. Shortly before the slide during the sewing operation reaches the column 2' of the sewing machine, the operator will release the clamping means by turning the lever 9 in clockwise direction, as viewed in FIG. 3. When the lever 9 is turned in clockwise direction, as viewed in FIG. 3, about the pivot 9', the lower curved face 13 of the lever 9 will roll on the upper face of the link 12 so that the free or right end of the connecting member 21', as viewed in FIG. 3, will be lifted to disengage the curved face 21'' from the cam face 22', permitting thereby the member 21 to move towards the right, as viewed in FIG. 3. Simultaneously with this movement the link 12 will pivot about is pivot 12'', and the support member 11 fixed to the clamping plate 10 will pivot, due to the force of the spring 23 about the axis 0 of the hinge 18 also in clockwise direction so that the ends of the two stringers of the slide fastener S will be released.

As the clamping plate 10 pivots upwardly, the pivot 14 moves along a circle having its center at 0 so that the arm 15 of the holding means 4 will tilt under the influence of the tensioned slip cover in the direction of the arrow A, facilitating thereby removal of the slip cover from the arm 15.

After release of the slide fastener and the slip cover, the slide 5 will move under the influence of the weight 7 connected thereto toward the left end of the guide rail 6 as viewed in FIG. 1 and abut against the bumper 10 which brakes the impact of the slide.

After the slide fastener is thus sewn onto the slip cover, the slip cover is turned around so that the inner side of the slide fastener will be located outwardly of the slip cover so that a slider for the slide fastener may be pulled onto the two stringers of the slide fastener in a manner known in the art.

It will be understood that each of the elements described above, or two or more together, may also find a useful application in other types of apparatus for sewing slide fasteners onto portions of a carrier to opposite sides of an elongated slit in which the carrier is elastic in the direction of the slit differing from the types described above.

While the invention has been illustrated and described as embodied in apparatus for simultaneously sewing two coupled stringers of a slide fastener onto portions of a carrier to opposite sides of an elongated slit therein in which the carrier is elastic in the direction of the slit, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. Apparatus for simultaneously sewing two coupled stringers of a slide fastener into portions of a carrier to opposite sides of an elongated slit therein, which is closed at one end, in which the carrier is elastic in the direction of the slit, the apparatus comprising a two-needle sewing machine having a needle plate; a slide having an upper substantially flat surface portion; holding means on said slide for releasably holding the coupled stringers of a slide fastener in the region of one end of the latter and the carrier in the region of its closed end of the slit therein on said slide, said holding means comprising a holding member connected to said slide and having an upright portion adapted to engage the carrier in the region of the closed end of the slit, and clamping means for clamping the slide fastener stringers in the region of said one end, said clamping means being movable between a clamping and a releasing position, and comprising a clamping plate having a bottom face facing said upper surface portion, hinge means connecting said clamping plate to said slide tiltable about an axis substantially parallel to said upper surface portion, a support member projecting upwardly from the clamping plate and having an upper end, a connecting member hingedly connected at one end to upper end of support member, a link pivotably connected at one to said connecting member and at the other end to said slide, a spring connected at opposite end to said support member and said slide, said holding means further comprising operating means connected to said connecting member and cooperating with said clamping plate for moving the latter between said clamping position in which said bottom face thereof is substantially parallel to said upper face portion of said slide so that the one end of said slide fastener may be clamped between said upper surface portion and said bottom face, and said releasing position; elongated guide means having one end fastened to said sewing machine and an opposite end for guiding said slide toward and away from said needle plate; and means connected to said slide for biasing the same with a constant force toward the opposite end of said guide means in a direction opposite to the advance of the slide fastener and the carrier during the sewing operation.

2. Apparatus as defined in claim 1, wherein said connecting member has opposite said one end a free curved end, and including a member carried by said slide in the region opposite from said clamping plate and having an upper cam face engaged by said curved free end of said connecting member, when said clamping means is in said clamping position, said operating means comprising a lever tiltably mounted on said connecting member between the ends of the latter and having a curved bottom face adapted to roll on an upper face of said link to lift, during tilting of the lever in one direction, said curved free end of said connecting member out of engagement with said cam face.

3. Apparatus for simultaneously sewing two coupled stringers of a slide fastener into portion of a carrier to opposite sides of a slit therein which is closed at one end thereof, in which the carrier is elastic in the direction of said slit, the apparatus comprising a two-needle sewing machine having a needle plate; a slide having an upper flat surface portion; holding means on said slide for releasably holding the coupled stringers of a slide fastener in the region of one end of the latter and the carrier in the region of said closed end of the slit therein on said slide, said holding means comprising a holding member connected to said slide and having an upright portion adapted to engage the carrier in the region of said closed end of said slit, and clamping means movable between a clamping and releasing position and comprising a clamping plate having a bottom face facing said upper surface portion, hinge means connecting said clamping plate to said slide tiltable about an axis substantially parallel to said upper surface portion so that said one end of the slide fastener may be clamped between said upper surface portion and said bottom face when said clamping means is in said clamping position, said holding member comprising a lever having a longer arm constituting said upright portion and a shorter arm extending transverse to said longer arm and being pivotally mounted on said clamping plate in the region of the latter distant from said hinge, said shorter arm having a bottom face engaging with a portion thereof an upper surface portion of the slide fastener, when said clamping means is in said clamping position, so that upon moving of said clamping means to said releasing position, said lever may be tilted to facilitate removal of said carrier from said longer arm; elongated guide means having one end fastened to said sewing machine and an opposite end for guiding said slide toward and away from said needle plate; and means connected to said slide for biasing the same with a constant force toward said opposite end of said guide means in a direction opposite to the advance of the slide fastener and said carrier during the sewing operation.

4. Apparatus for simultaneously sewing two coupled stringers of a slide fastener into portions of a carrier at opposite sides of an elongated slit therein, which is closed at one end, and in which the carrier is elastic in the direction of the slit, the apparatus comprising a two-needle sewing machine having a needle plate; a slide having a upper flat surface portion; means on said slide for releasably holding said coupled stringers of a slide fastener in the region of one end of the latter and the carrier in the region of said closed end of said slit thereon on said slide, said holding means comprising a holding member connected to said slide and having an upright portion adapted to engage the carrier in the region of the closed end of the slit, clamping means comprising a clamping plate having a bottom face facing said upper surface portion, hinge means connecting said clamping plate to said slide tiltable about an axis substantially parallel to said upper surface portion between a clamping and releasing position for clamping, in said clamping position, the one end of the slide fastener between said upper surface portion and said bottom face, and operating means connected to said clamping means for moving said clamping plate between said positions thereof; elongated guide means having one end fastened to said sewing machine and an opposite end; and means connected to said slide for biasing the same with an constant force toward the opposite end of said guide means in a direction opposite to the advance of the slide fastener and the carrier during the sewing operation.

5. Apparatus as defined in claim 4, wherein said guide means comprises an elongated guide rail, said slide being slidably mounted on said guide rail.

6. Apparatus as defined in claim 4, wherein said biasing means comprises an elongated flexible member connected at one end to said slide and a weight connected to the other end of said elongated flexible member.

7. Apparatus as defined in claim 6, and further comprising a roller mounted on said opposite end of said elongated guide means, said flexible member extending over said roller.

8. Apparatus as defined in claim 4, and including a springy shock absorber at said opposite end of said elongated guide means.

* * * * *